US012656041B2

(12) United States Patent
Bucceri

(10) Patent No.: US 12,656,041 B2
(45) Date of Patent: Jun. 16, 2026

(54) REMOTE, MULTI-FUNCTIONAL SNOW-MAKING APPARATUS

(71) Applicant: Alfio Bucceri, Brisbane (AU)

(72) Inventor: Alfio Bucceri, Brisbane (AU)

( * ) Notice: Subject to any disclaimer, the term of this patent is extended or adjusted under 35 U.S.C. 154(b) by 205 days.

(21) Appl. No.: 18/419,880

(22) Filed: Jan. 23, 2024

(65) Prior Publication Data

US 2024/0271846 A1 Aug. 15, 2024

Related U.S. Application Data

(60) Provisional application No. 63/462,325, filed on Apr. 27, 2023.

(30) Foreign Application Priority Data

Feb. 15, 2023 (AU) ..... 2023900367

(51) Int. Cl.
*F25C 3/04* (2006.01)

(52) U.S. Cl.
CPC ..... *F25C 3/04* (2013.01); *F25C 2303/042* (2013.01); *F25C 2303/046* (2013.01)

(58) Field of Classification Search
CPC ..... F25C 3/04; F25C 2303/042; F25C 2303/046; F25C 1/145; F25C 2303/048
See application file for complete search history.

(56) References Cited

U.S. PATENT DOCUMENTS 4,742,958 A 5/1988 Bucceri
4,793,142 A 12/1988 Bucceri
4,823,518 A * 4/1989 Dilworth ..... F25C 3/04 239/587.5
5,297,731 A 3/1994 Bucceri
6,454,182 B1 9/2002 Bucceri
6,938,830 B2 9/2005 Bucceri
6,951,308 B2 10/2005 Bucceri
8,403,242 B2 3/2013 Bucceri
9,909,796 B2 3/2018 Bucceri
11,092,373 B2 8/2021 Handfield
11,473,822 B2 10/2022 Bucceri
(Continued)

FOREIGN PATENT DOCUMENTS

JP 0788651 B2 9/1995
WO WO-02061353 A1 * 8/2002 ..... F25C 3/04
WO 2020084501 A1 4/2020

*Primary Examiner* — Len Tran
(74) *Attorney, Agent, or Firm* — Hudak, Shunk & Farine Co. LPA

(57) ABSTRACT

A snow-making apparatus including an ice particle generating machine that produces ice particles that can be utilized to make or use as high quality man-made snow, and a system for remotely discharging the ice particles remotely from the ice particle generating machine through the use of one or more of a fan impeller assembly and a chilled air sealed pneumatic air conveying system. In one preferred embodiment, the apparatus further includes a water droplet or particle dispenser located remotely from the ice particle generating machine and preferably adjacent to the outlet of the apparatus where ice particles are discharged from an outlet pipe, whereby the water droplets are mixed with the ice particles thereby producing snow. Using a combination of ice particles and water droplets allows production of snow efficiently and in large quantities.

20 Claims, 7 Drawing Sheets

(56) References Cited

U.S. PATENT DOCUMENTS

| | | | | |
|---|---|---|---|---|
| 2011/0147498 | A1* | 6/2011 | Bucceri | F25C 5/046 241/154 |
| 2016/0040920 | A1* | 2/2016 | Bucceri | F25C 3/04 239/14.2 |
| 2019/0078825 | A1* | 3/2019 | Handfield | F25C 3/04 |
| 2020/0132353 | A1* | 4/2020 | Bucceri | A01G 15/00 |
| 2022/0268505 | A1* | 8/2022 | Bucceri | A01G 15/00 |

* cited by examiner

REMOTE, MULTI-FUNCTIONAL SNOW-MAKING APPARATUS

FIELD OF THE INVENTION

The present invention relates to a snow-making apparatus including an ice particle generating machine that produces ice particles that can be utilized to make or use as high quality man-made snow, and a system for discharging the ice particles remotely from the ice particle generating machine through the use of one or more of a fan impeller assembly and a chilled air sealed pneumatic air conveying system. In preferred embodiments, the apparatus further includes a water droplet or particle dispenser located remotely from the ice particle generating machine and preferably adjacent to the ice particle outlet of the apparatus where ice particles are discharged from an outlet pipe, whereby the water droplets are mixed with the ice particles thereby producing additional snow. Using a combination of ice particles and water droplets allows production of snow efficiently and in large quantities.

BACKGROUND OF THE INVENTION

Many different devices have been proposed in the art for manufacturing artificial snow for use on ski slopes, at theme parks, test and training facilities or general entertainment. Some examples of the inventor's own snow making devices are set forth in U.S. Pat. Nos. 4,742,958; 4,793,142; 5,297,731; 6,454,182; 6,938,830; 6,951,308; 8,403,242; 9,909,796; and 11,473,822.

As natural snow is seasonal, and sufficient natural snowfall cannot be guaranteed, two general types of snow-making devices exist in the art, namely plus temperature snow-making devices and minus temperature snow-making devices. Plus temperature snow-making devices can be typically utilized when temperatures are below freezing as well as above freezing temperatures up to about 30 degrees Celsius (86° F.). Minus temperature snow-making devices are generally operated below the freezing point of water and utilize water droplets which are seeded into the air and freeze, thereby turning into ice or snow-like particles prior to hitting the ground.

Apparatuses that provide a combination of both types of systems are described in U.S. Pat. Nos. 9,909,796 and 11,473,822.

In view of the above, the art still needs a snow-making apparatus that can be used to spread snow and ice particles at many different locations without too much difficulty in moving relatively bulky and/or heavy equipment from one location to another.

To this end, various devices have been proposed in the art.

JPH 0788651 discloses an apparatus for reportedly transporting and dispersing a large amount of snow or ice particles from a lowland having a relatively large elevation difference to a highland. More specifically, an ice making facility is provided in a lowland of a ski resort, for example, in order to spread a large amount of snow and ice particles on a ski course of a ski resort and maintain the ski slope so that it can be skied or to make skiing more comfortable.

U.S. Pat. No. 11,092,373 discloses a snow conveying assembly for use with a snow making machine that includes an impeller for receiving snow from the snow making machine and accelerating the snow; and an ejector tube, which receives the snow from the impeller, further accelerates the snow and discharges the snow from the assembly. The ejector tube contains a venturi throat. Snow from the impeller is conveyed via a snow inlet tube into the ejector tube immediately upstream of a venturi throat and air under pressure is blown into the ejector tube upstream of the venturi throat to further accelerate the snow.

WO 2020/084501 discloses a distribution terminal for a transport conduit of ice and/or snow extending between an inlet thereof and an outlet thereof, comprising at least one distribution element rotating in relation to the transport conduit along a rotation axis (A) substantially parallel to a distribution direction (D) of the ice and/or snow at the outlet of the transport conduit. The distribution element is configured to radially distribute in relation to the rotation axis (A) a flow of ice and/or snow in output from the transport conduit along the distribution direction (D), The distribution element also has a concavity (C) at least partially facing the outlet of the transport conduit and configured to at least partly radially divert the ice and/or snow in relation to the distribution direction (D) so as to provide the radial distribution.

While the above-identified art discloses some solutions to providing snow or ice particles, the art still needs a multi-functional snow-making apparatus that can furnish remote distribution and creation of snow and ice particles at many different temperature ranges, including sub-freezing and above-freezing conditions. Still further, the art needs a solution that is cost effective. In addition, the snow-making apparatus cannot be considered an eye-sore at the location of use.

SUMMARY OF THE PRESENT INVENTION

In view of the above, the problems of the prior art and others are solved with the remote, multi-functional snow-making apparatus of the present invention, which can be utilized at a wide temperature range including sub-freezing temperatures as well as above-freezing temperatures. The apparatus can alternatively function as i) an ice particle generating machine that discharges ice particles that provide high quality artificial snow at a remote location, or ii) as a minus-temperature apparatus wherein water particles can be blown from nozzles in sub-freezing conditions which form snow or ice particles prior to reaching the ground, or iii) as a hybrid device which produces ice particles which are discharged from the apparatus and mixed with water droplets expelled from nozzles of the apparatus which are converted to snow. Thus, in the hybrid embodiment, the ice particles formed are used as nuclei to make additional snow at low temperatures when mixed with water expelled at a pressure from about 150 psi to about 1,000 psi for example, to create water particles, for example having a diameter from about 100 to about 1,500 microns in size. The water droplets and ice particles are collided with each other and interact to make additional snow at a higher volume when the water particles are blown in a path that intersects the path of the ice particles and pressurized delivery air, for example at an angle of 65° to about 85°.

The apparatus of the present invention has the advantage of providing a carriage that can serve as a stand that can be used remotely from an ice particle generating machine in order to disperse ice particles at a distant location and/or disperse water particles that can be utilized to create snow in sub-freezing temperatures, which is small, light-weight, mobile and can be used with or without a power source, which provides many operational advantages to an operator.

A further advantage is the ability to save on capital infrastructure by not having to provide a power source at the remote location where snow is delivered to a ground surface.

Still another advantage is the ease of moving the carriage and the ability to use the snow-making apparatus in remote locations where snow would otherwise not be able to be produced, due to access or lack of infrastructure such as a power source.

Yet another advantage is that the apparatus provides snow and/or ice particles that are easy to blow or vacuum and water that can be pumped over long distances to make snow.

Another advantage of the apparatus is that the noise involved in the snow-making process can be reduced by operating the fan impeller assembly, or blower for an air conveying system in an acoustic enclosure remote from the area where the snow is to be provided.

In the above freezing environments, the ice particles or snow are blown directly to the ground to create skiing or toboggan slopes and can be used for example, as a falling snow, snow for saunas, events, cooling purposes, entertainment centers, indoor ski centers, restaurants, hotels, amusement parks, or any location where real snow is desirable to patrons.

When the apparatus is utilized at above-freezing temperatures, the snow can be used for any desired activity or otherwise stockpiled for later use when the temperature is below about 40° F. (4.44° C.). When stockpiled, the snow can be recycled through the apparatus and mixed with water to make additional quantities of snow.

Accordingly, in one aspect, a remote, multi-functional snow-making apparatus is disclosed, comprising an ice particle generating machine comprising:

a) a freezer unit that converts water to ice; and b) a comminuting device that reduces the ice produced by the freezer unit to ice particles smaller in size than the ice;

a fan impeller assembly that receives the ice particles from the ice particle generating machine and having a fan having blades that create airflow and further reduce the size of the ice particles;

an elongated delivery pipe having a length of at least 2 meters disposed between an outlet pipe of the apparatus and an outlet of the fan impeller assembly;

wherein the outlet pipe that receives the ice particles discharged from the fan impeller assembly directs the ice particles into the air from an outlet of the outlet pipe into the air; and a water manifold disposed adjacent to the outlet pipe, wherein a plurality of water nozzles are connected to the water manifold that expel pressurized water therethrough in the form of water droplets, and wherein the ice particles discharged from the outlet pipe mix with the water droplets expelled from the water nozzles thereby producing snow.

In still another aspect, a remote, multi-functional snow-making apparatus is disclosed, comprising:

an ice particle generating machine comprising:

a) a freezer unit that converts water to ice; and b) a comminuting device that reduces the ice produced by the freezer unit to ice particles smaller in size than the ice;

a first fan impeller assembly that receives the ice particles from the ice particles generating machine and having a fan having blades that create airflow and further reduce the size of the ice particles;

an elongated delivery pipe having an inlet connected to an outlet of the first fan impeller assembly and an outlet disposed at least 2 meters from the inlet;

a second fan impeller assembly located downstream from the outlet of the delivery pipe, wherein the second fan impeller assembly has a fan having blades that create air flow and further reduce the size of the ice particles received from the delivery pipe; and an outlet pipe that receives the ice particles discharged from the second fan impeller assembly and directs the ice particles into the air from an outlet of the outlet pipe into the air.

A still further aspect discloses a remote, multi-functional snow-making apparatus, comprising:

an ice particle generating machine comprising:

a) a freezer unit that converts water to ice; and b) a comminuting device that reduces the ice produced by the freezer unit to ice particles smaller in size than the ice;

an elongated delivery pipe having an inlet that receives ice particles from the ice particle generating machine;

a fan impeller assembly located downstream from the delivery pipe and having a fan having blades that create airflow and further reduce the size of the ice particles;

a chilled air sealed pneumatic air conveying system that includes an axial or centrifugal fan, and an air cooler, wherein the air conveying system has an outlet located between the ice particle generating machine and the fan impeller assembly, wherein the air conveying system further includes a sealed rotary valve which receives ice particles from the ice particle generating machine and blows the ice particles to the fan impeller assembly; and an outlet pipe that receives the ice particles discharged from the fan impeller assembly and directs the ice particles into the air from an outlet of the outlet pipe into the air.

BRIEF DESCRIPTION OF DRAWINGS

The invention will be better understood, and other features and advantages will become apparent by reading the detailed description of the invention, taken together with the drawings, wherein.

DETAILED DESCRIPTION OF THE DRAWINGS

Figure 1:
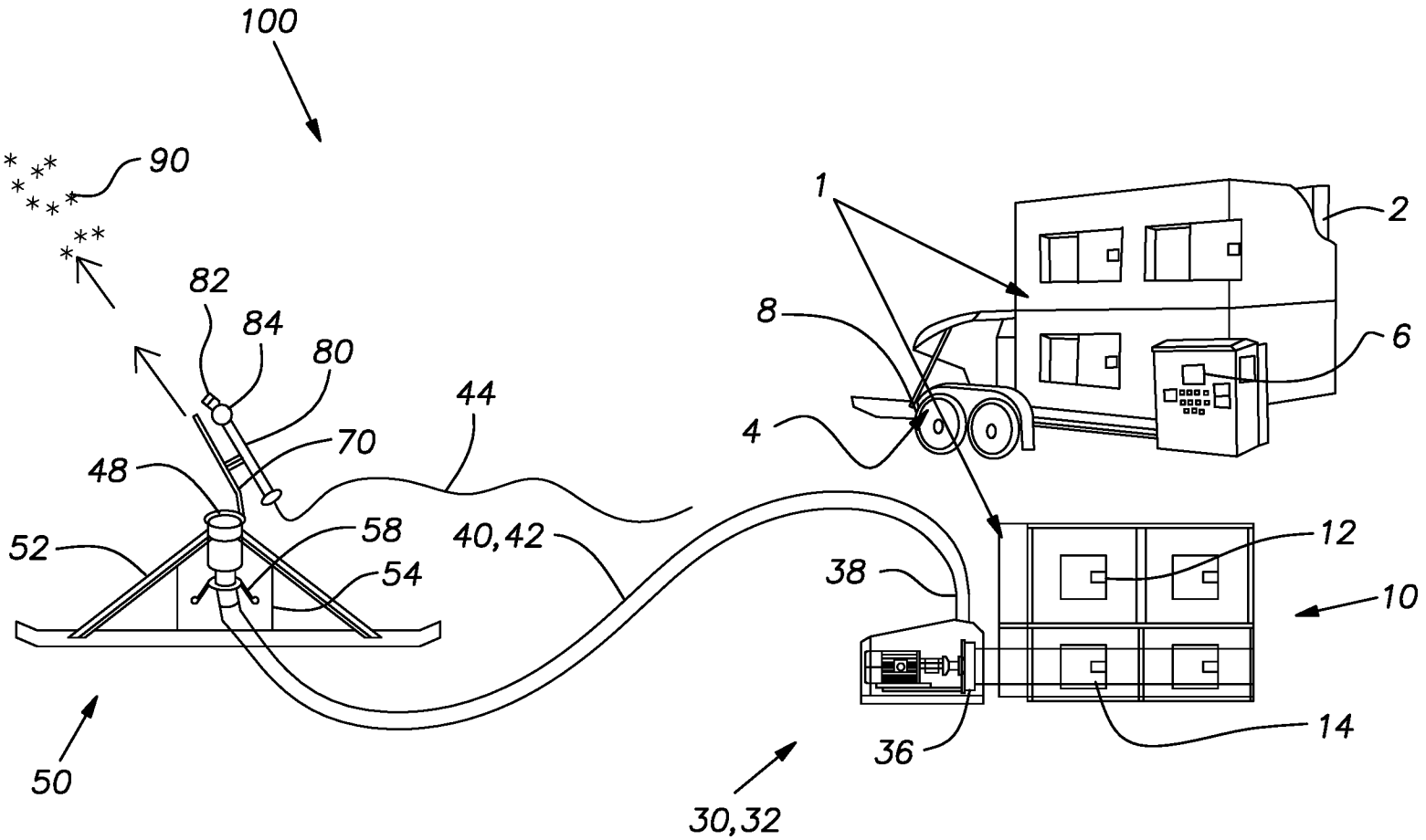
FIG. 1 is a schematic diagram of one embodiment of a remote, multi-functional snow-making apparatus of the present invention which is suitable for transporting ice particles formed by an ice particle generating machine to a location distant from the machine and mixing the ice particles with water droplets expelled from nozzles of the apparatus which are then converted to snow.

This description of preferred embodiments is to be read in connection with the accompanying drawings, which are part of the entire written description of this invention. In the description, corresponding reference numbers are used throughout to identify the same or functionally similar elements. Relative terms such as "horizontal," "vertical," "up," "upper", "down," "lower", "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and are not intended to require a particular orientation unless specifically stated as such. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship.

Turning now to the drawings, wherein like reference numbers refer to the same or like parts or structure throughout the description, a remote, multi-functional snow-making apparatus (100) is illustrated in FIG. 1. The apparatus (100) includes a base unit (1) preferably including an enclosure (2) that surrounds and houses various components of the apparatus. The base unit preferably includes a frame (4) upon which various components are mounted. In some embodiments the base unit (1) includes wheels (8) which allow the base unit (1) to be transported from location to location. A control panel (6) is also illustrated for actuating apparatus (100) and the individual components thereof that can be controlled via a computer, programmable logic controller or the like.

Base unit (1) includes an ice particle generating machine (10) having ice maker or freezer unit (12) which converts water to ice. The ice particle generating machine can assume a number of different forms, such as a freezer unit for example as disclosed in U.S. Pat. No. 11,473,822, herein fully incorporated by reference. The ice particle generating machine can also be an ice maker. In any case, the ice maker or freezer unit (12) produces ice in one form or another, such as, but not limited to, cubes, flakes, and chunks. In some embodiments the ice maker or freezer unit (12) comprises a drum evaporator freezer having an inner wall cooled by a refrigerator condensing unit so that water flowing down the inner wall is frozen and converted to ice.

The ice particle generating machine (10) includes a comminuting device (14) the reduces the ice produced by the ice maker or freezer unit into smaller ice particles. In one preferred embodiment, the comminuting device comprises a scraper blade assembly which is located in the drum evaporator freezer that scrapes ice off of the inner wall and converts the ice to ice particles. In additional embodiments, ice produced by the freezer unit or ice maker are supplied to a comminuting device (14) which is a crusher that reduces the ice to ice particles.

The ice particles discharged from the comminuting device (14) are transferred by conveying system (30) to delivery conduit (40). In some embodiments the conveying system comprises a screw conveyor (36) and a fan impeller assembly (32) such as illustrated in FIG. 1. Various fan impeller assemblies are known in the art and set forth for example in U.S. Pat. Nos. 9,909,796 and 11,473,822, herein fully incorporated by reference. The fan impeller assembly includes a motor that drives the fan impeller unit at various speeds, as controllable via the control panel with a programmable logic controller to control the rotation direction and speed of the motor. The fan impeller includes one or more blades which impact the ice particles for reducing the size of at least some of the particles. The fan impeller discharges the ice particles (90) through an outlet pipe (38) thereof directly or indirectly into delivery conduit (40).

Figure 5:
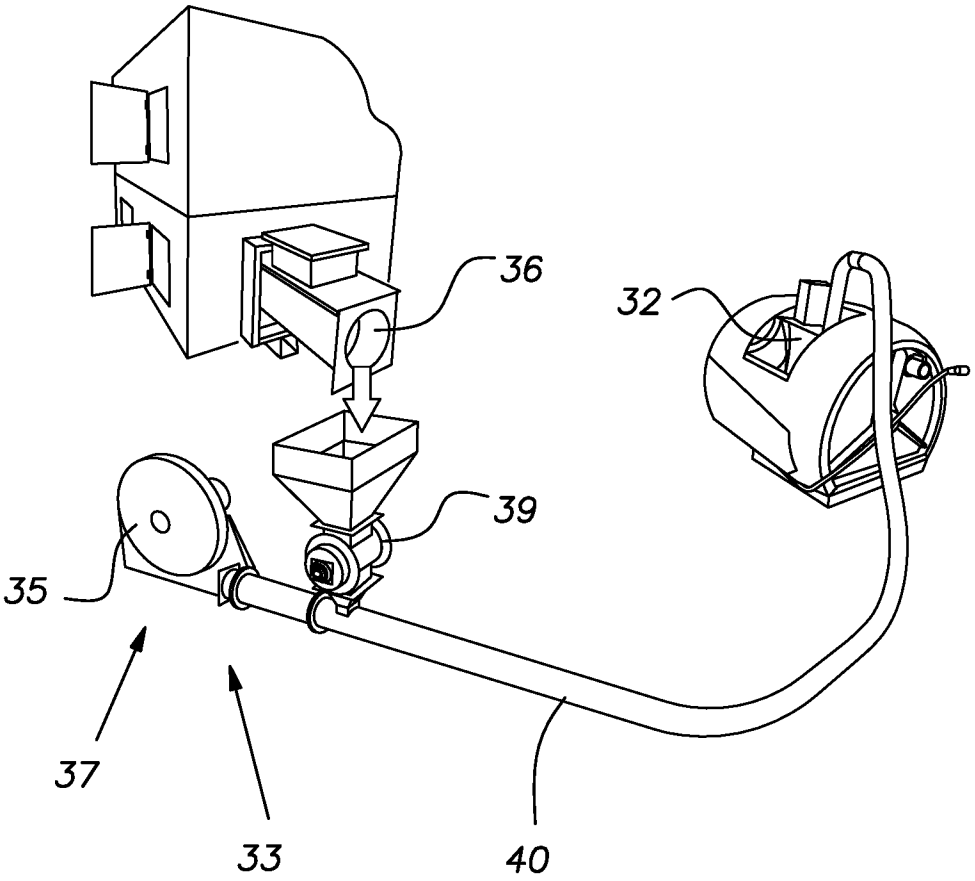
FIG. 5 is a schematic diagram of one embodiment of a remote, multi-functional snow-making apparatus of the present invention which includes an ice particle generating machine and a chilled air sealed pneumatic air conveying system that transmits ice particles to a remote carriage for dispersion into the air and optionally mixing with water droplets.
Figure 5:
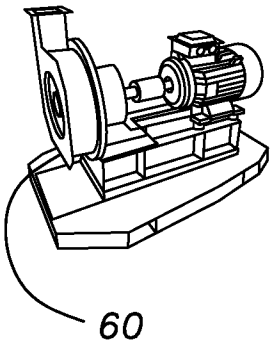
Figure 6:
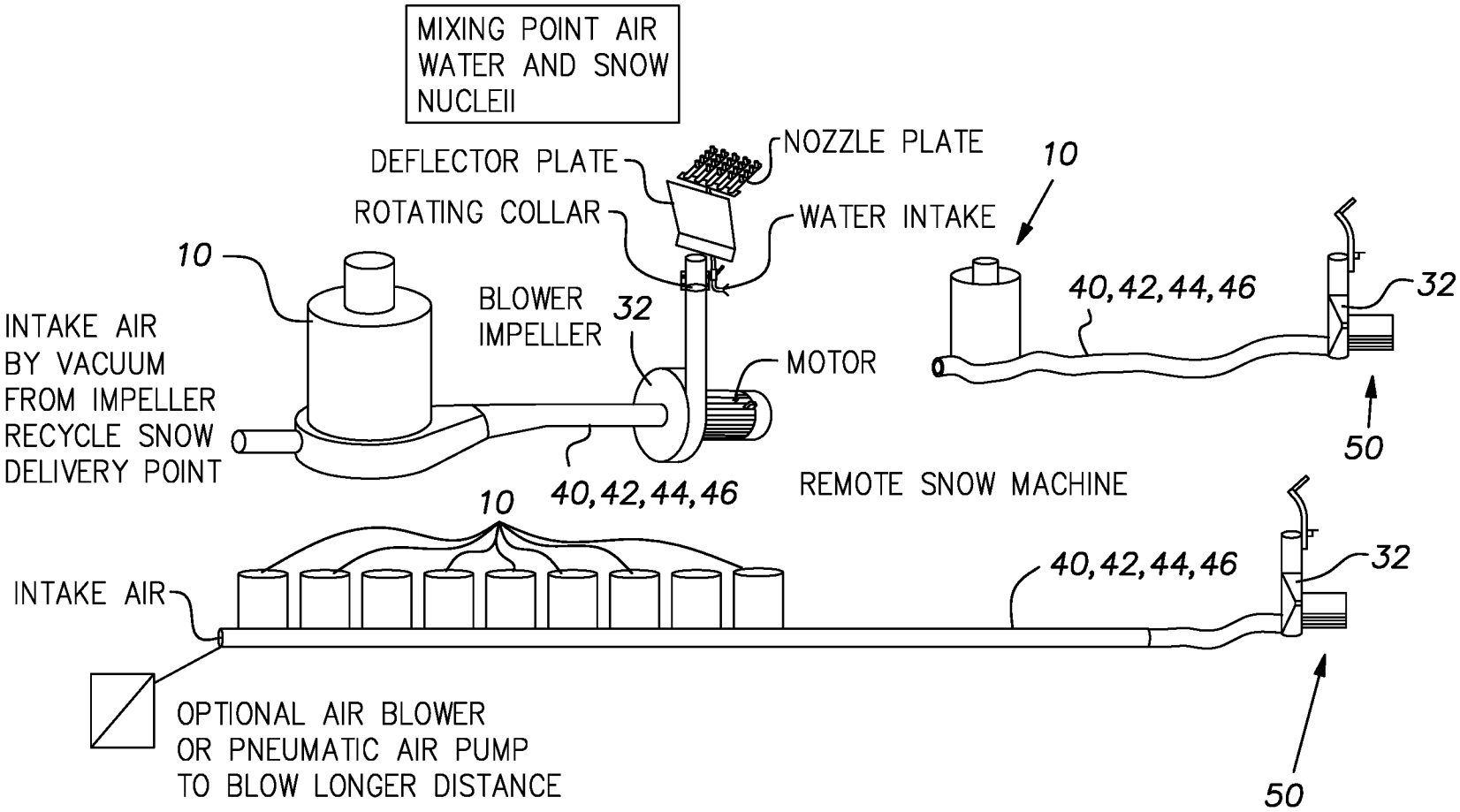
FIG. 6 is a schematic diagram showing additional embodiments of the apparatus of the invention.

In still other embodiments, the conveying system (30) is a chilled air sealed pneumatic air conveying system (33) for example as shown in FIGS. 5 and 6. The conveying system (33) in one embodiment includes an axial or centrifugal fan (35) and air cooler (37) which blows cold conveying air and transfers the ice particles exiting the ice particle generating machine (10) into delivery conduit (40).

Delivery conduit (40) includes at least an ice particle delivery pipe (42).

In one embodiment, the delivery conduit (40) includes an integral ice particle delivery pipe (42), water line (44), and power line (46). In such an embodiment, only one construction, namely the delivery conduit (40) needs to be run between the base unit (1) and the carriage (50) in order to facilitate connection to a remote location.

By providing a delivery conduit (40) with a water line (44) and a power line (46), with the ice particle delivery pipe (42) by being operatively connected thereto aids in preventing damage to the water line and power line as compared to when such lines are individually run to the carriage when necessary or desired.

The ice particle delivery pipe (42) is preferably formed from a durable, flexible material polymer tube or metal wire reinforced polymer tube. The type of polymer utilized to form ice particle delivery pipe (42) is selected to ensure smooth transfer of ice particles therethrough. Suitable materials include, but are not limited to, polyvinylchloride, polyethylene-based pipes, and thermoplastic elastomer materials. In other embodiments, metal pipes can be utilized if desired. The delivery conduit (40) including at least the ice particle delivery pipe (42) has a length generally from about 20 to about 100 meters, desirably from about 30 to about 80 meters, and preferably from about 30 to about 50 meters.

The interior diameter of the ice particle delivery pipe (42) can vary depending upon factors such as the number of ice particle generating machines desired to be operatively connected thereto as well as the amount or volume of ice particles adapted to be transported through the pipe per length of time. That said, inner diameters of ice particle delivery pipe (42) range from about 7 to about 30 centimeters, desirably from about 10 to about 25 centimeters, and preferably from about 10 to about 20 centimeters.

Apparatus (100) preferably has a discharge outlet (48) operatively connected to carriage (50) such as shown in FIG. 1 to which an outlet of ice particle delivery pipe (42) is operatively connected, such as through camlock fitting (58).

Figure 4:
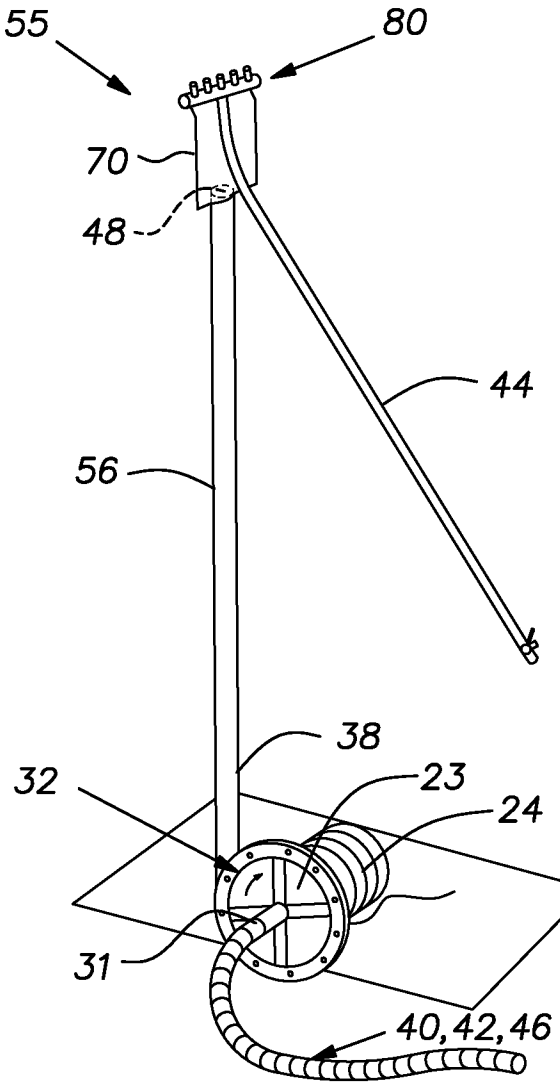
FIG. 4 schematically illustrates one embodiment of a remote carriage of the apparatus which includes an ice particle outlet, discharge outlet, a water droplet sprayer device and a fan impeller assembly connected to an outlet of a delivery conduit, and further including a vertical extension located between the fan impeller assembly and the water droplet sprayer device and ice particle discharge outlet for discharging the ice particles and water droplets at a greater height above the ground surface.

Carriage 50 includes a frame (52) and a stand (54) which operatively supports discharge outlet (48). In an embodiment such as shown in FIG. 4, the frame also supports vertical extension pipe (56) which positions or extends the discharge outlet (48) at a desired height above the ground surface such as from about 0.5 to about 15 meters, desirably from about 1 to about 10 meters and preferably from about 2 to about 8 meters. In some embodiments the carriage includes one or more of wheels and sleds or trailer mount on wheels or sled which facilitate the ability to transport or otherwise move the carriage relatively easily to a remote location.

In a preferred embodiment, a deflector plate (70) is operatively connected to the carriage such that it is located adjacent discharge outlet (48). As some of the ice particles are exhausted from the discharge outlet (48), they collide with the deflector plate (70) and can be further pulverized and thrown outwardly at a very high speed. The deflector plate (70) is adjustable and can be used to fan the particles at any angle, such as sideways, upwardly, or downwardly, depending upon the curvature and the shape of the plate. The deflector plate (70) is connected to the carriage (50) by any suitable means.

The deflector plate (70) further reduces the size of the snow seeds or ice particles (90) by impact with the plate for example so that the micron size is reduced to the target of 50 to 200 micron required for nucleation. The ability to turn the deflector plate 360 degrees means that the snow or ice particles can be blown downwind which is an important aspect of making snow, creating more hangtime for snow to form before hitting the ground. The deflector plate fans the ice particles exiting the delivery pipe whereby the water droplet sprayer device can be made of a wide length to cater for more nozzles and to mix water droplets with the snow seeds or ice particles. The deflector plate can be turned manually or automatically by an actuator connected to a wind direction instrument which turns automatically as the wind changes direction.

A water droplet sprayer device (80) is also operatively connected to carriage (50). Water line (44) is connected to an inlet of the water sprayer device (80), for example as shown in FIG. 1. What sprayer device (80) is effective for creating additional snow or ice particles at temperatures below freezing. Water spray apparatus includes water nozzles (82) which are preferably connected to manifold (84) which receives water from water line (44). In a preferred embodiment, the manifold is heated with a heater (86) having heating elements (87) and heating head (88) to prevent the water from freezing therewithin during operation.

Figure 2:
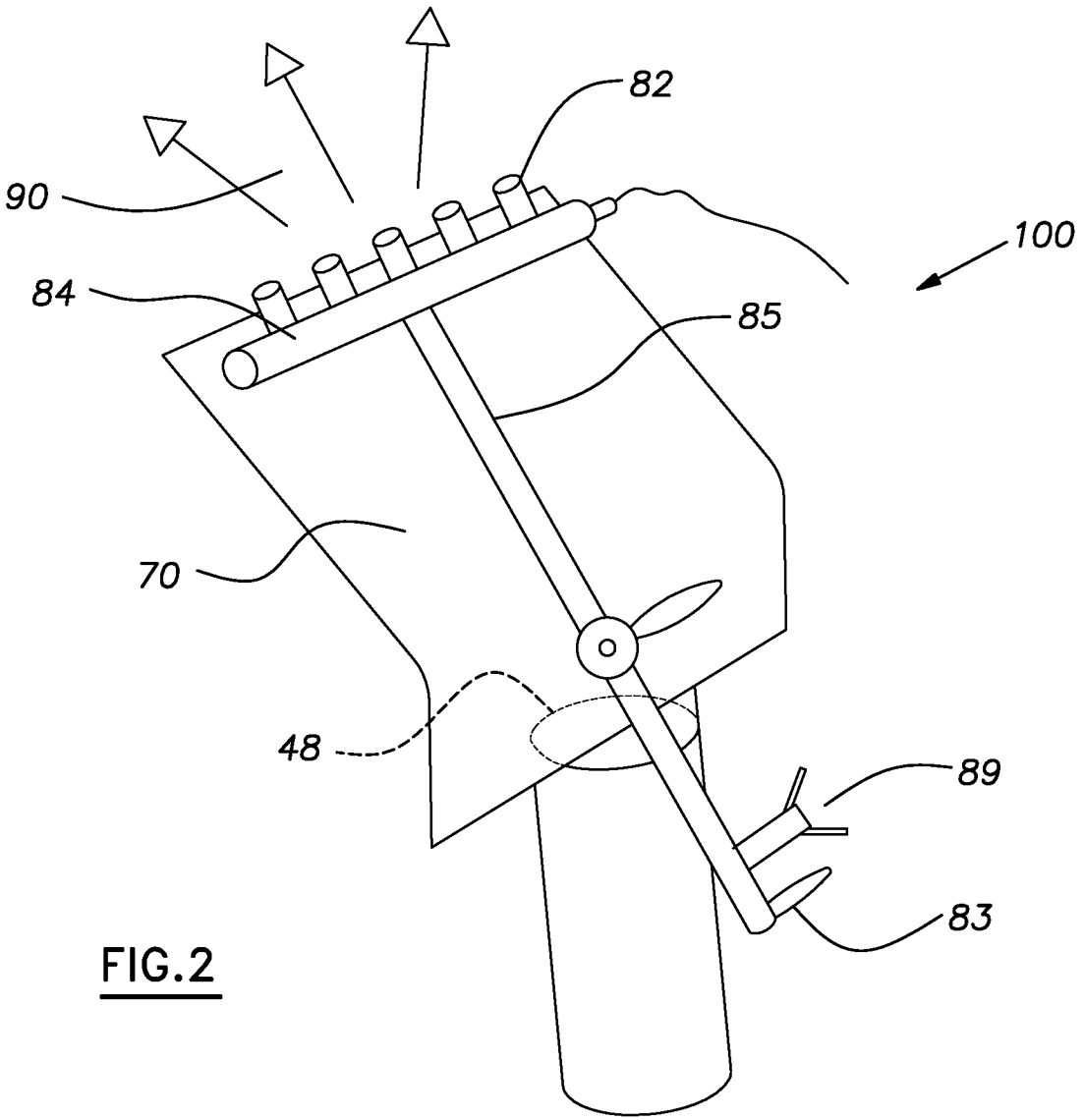
FIG. 2 is a close-up schematic view of the ice particle and water droplet discharge system of the apparatus including an ice particle outlet, a deflector plate and portions of a water droplet sprayer device.

FIG. 2 shows a portion of the remote snow making apparatus (100) provided with a water manifold (84) and nozzles (82) and a heated water delivery pipe (85) with drain (83) and high pressure hose coupling (89) to allow for additional snow creation at temperatures below 40° F. (4.44° C.). Snow is produced below this temperature by mixing the atomized water droplets with the air and ice particles delivery stream either with the aid of the deflector plate (70) or by blowing directly into the stream of ice particles (90).

Figure 3:
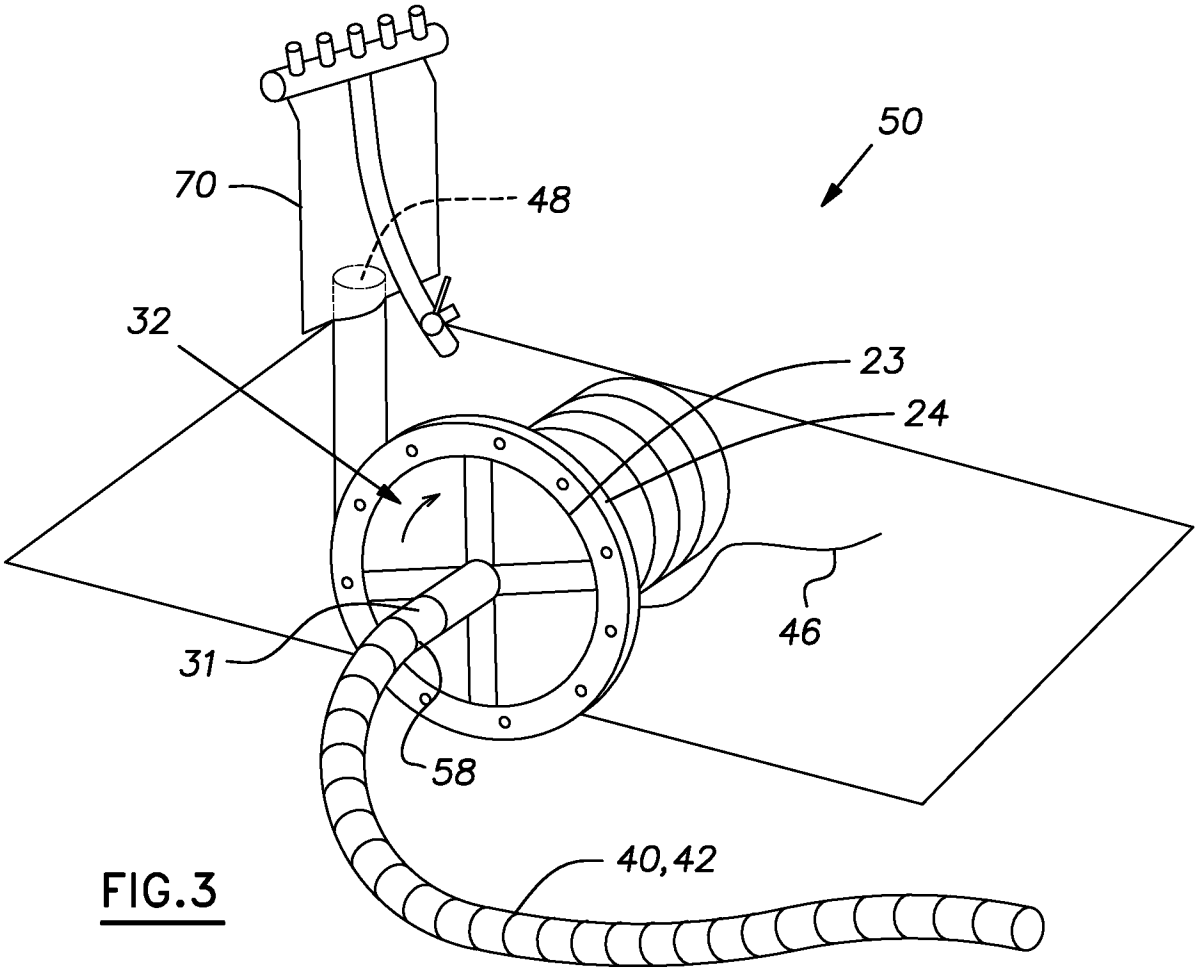
FIG. 3 schematically illustrates one embodiment of a remote carriage of one embodiment of the apparatus which includes an ice particle discharge outlet, a water droplet sprayer device and a fan impeller assembly connected to an outlet of a delivery conduit.

FIG. 3 shows a fan impeller assembly (32) connected with the remote snow making apparatus carriage (50) to provide additional air suction and delivery pressure downstream of delivery conduit (40) including the ice particles delivery pipe (42). The flexible delivery pipe (42) is connected by a preferred camlock fitting (58) to the inlet pipe (31) of the fan impeller blower intake cover (23) whereby the air and ice seeds collide with the blades (24) of the fan impeller (32) and are expelled from the ice particles discharge outlet (48) onto the deflector plate (70) of the remote snow-making apparatus (100).

FIG. 4 shows remote carriage (50) including a tower mount (55) where the ice particle discharge outlet (48) is connected to a vertical extension pipe (56) that is connected to the defector plate (70) and water droplet sprayer device (80) at a height of up to 12 meters above the ground. Carriage (50) in this embodiment includes fan impeller assembly (32) having an inlet connected to an outlet of ice particle delivery pipe (42) of delivery conduit (40). Power line (46) powers the fan impeller assembly (32). Outlet pipe (38) of fan impeller assembly (32) is operatively connected to vertical extension pipe (56).

FIG. 5 shows a proprietary chilled air sealed pneumatic air conveying system (33) that includes an axial or centrifugal fan (35) and air cooler (37) that blows cold conveying air below a rotary valve (39), for example up to distances of 300 meters, from the axial fan (35) location.

In this embodiment the blower impeller assembly (60) and the ice particle generating machine (10) and conveyor (36) of the multi-functional snow making apparatus are separated and the rotary valve pneumatic air conveying system (33) is positioned between these components.

The sealed rotary valve (39) is connected to the outlet of the screw conveyor (36) of the multi-functional snow-making apparatus and the ice particles (90) made by the ice particle generating machines (10) are distributed evenly into the cold air flow piping as the rotary valve (39) turns. These ice particles then are vacuumed by the fan impeller assembly (32) of the snow-making apparatus and blown by axial fan (35) to make snow.

FIG. 6 shows a further embodiment of the invention including multiple ice particle generating machines (10) arranged downstream from delivery conduit (40) including delivery pipe (42), a water line (44) and power line (46). The delivery conduit (40) is operatively connected to carriage (50) having components such as described above with respect to FIG. 1 and herein fully incorporated by reference. As a further option, the device includes the use of one or more in-line vacuum air pump conveying systems (92) run by compressed air to create a vacuum using the Coanda effect such as an Air Amplifier™ sold by Exair. In this embodiment the small pipe-like parts are placed upstream of the ice machines to generate a stronger vacuum effect to assist with the ice particle movement. In a further embodiment, the snow-making apparatus further includes one or more compressed air operated inline vacuum pump conveying systems, wherein at least one of the conveying systems (92) is located between the ice particle generating machine and a fan impeller assembly of the carriage and blows the ice particles to the fan impeller assembly, see FIG. 6 for example. In additional embodiments when multiple compressor operated inline vacuum pump conveying systems are utilized, they can be spaced at intervals such as, but not limited, between about 20 to 35 meters. Reference https://www.exair.com/products/air-operated-conveyors/line-vac.html and https://www.exair.com/sal.html#wk3dimage.

Figure 7A:
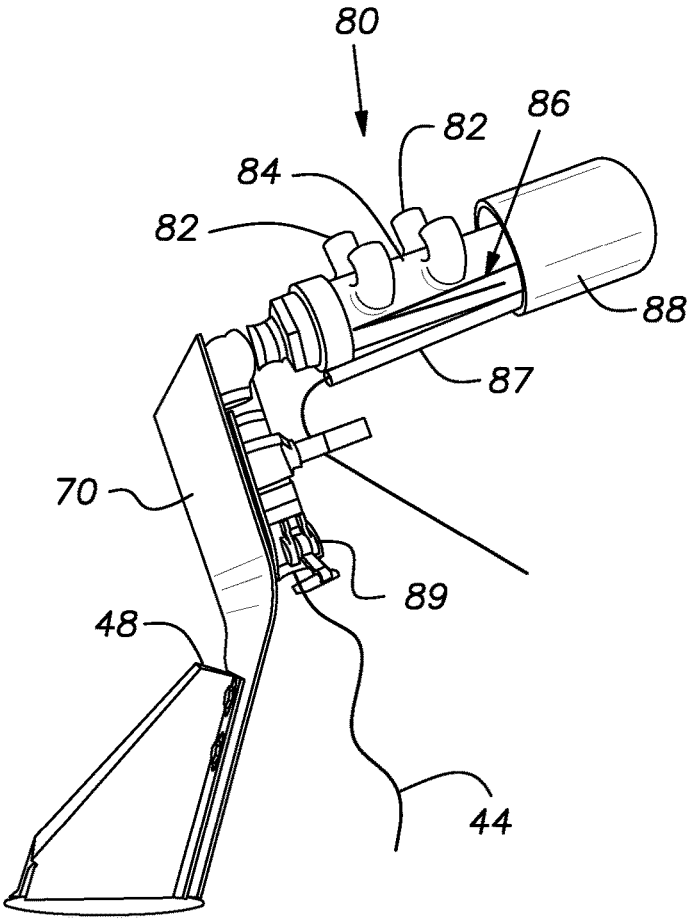
FIGS. 7A and 7B illustrate one embodiment of a discharge system of the apparatus including an ice particle outlet, a deflector plate and water droplet sprayer device including a heater head and heater element.
Figure 7B:
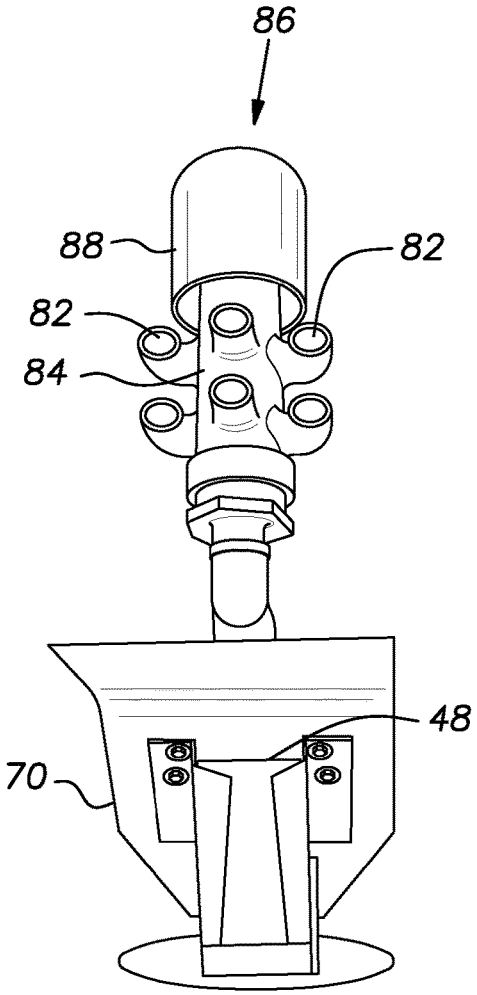

FIGS. 7A and 7B illustrate a detailed view of the outlet portion of apparatus (100) including ice particle discharge outlet (48), with deflector plate (70) operatively connected thereto. The view also includes a detailed illustration of water droplet sprayer device (80) that includes manifold (84), nozzles (82), heater (86) including heating elements (87) and heating head (88). Water coupling (89) is also shown that is adapted to connect to water line (44), not shown in this view. The solenoid valves and nozzles are connected to a control panel that is programmed to open the valves when the temperature drops below a set temperature.

For the avoidance of doubt, the apparatus and devices of the present invention encompass all possible combinations of the components, including various ranges of said components, disclosed herein. It is further noted that the term 'comprising' does not exclude the presence of other elements. However, it is also to be understood that a description of an apparatus comprising certain components also discloses a product consisting of these components. Similarly, it is also to be understood that a description of a process comprising certain steps also discloses a process consisting of these steps.

In other aspects of the invention, devices and methods include the following.

1. A remote, multi-functional snow-making apparatus, comprising: an ice particle generating machine comprising: a) a freezer unit that converts water to ice; and b) a comminuting device that reduces the ice produced by the freezer unit to ice particles smaller in size than the ice; a fan impeller assembly that receives the ice particles from the ice particle generating machine and having a fan having blades that create airflow and further reduce the size of the ice particles; an elongated delivery pipe having a length of at least 1 meters disposed between an outlet pipe of the apparatus and an outlet of the fan impeller assembly; wherein the outlet pipe that receives the ice particles discharged from the fan impeller assembly directs the ice particles into the air from an outlet of the outlet pipe into the air; and a water manifold disposed adjacent to the outlet pipe, wherein a plurality of water nozzles are connected to the water manifold that expel pressurized water therethrough in the form of water droplets, and wherein the ice particles discharged from the outlet pipe mix with the water droplets expelled from the water nozzles thereby producing snow.

2. A remote, multi-functional snow-making apparatus, comprising: an ice particle generating machine comprising: a) a freezer unit that converts water to ice; and b) a comminuting device that reduces the ice produced by the freezer unit to ice particles smaller in size than the ice; a first fan impeller assembly that receives the ice particles from the ice particles generating machine and having a fan having blades that create airflow and further reduce the size of the ice particles; an elongated delivery pipe having an inlet connected to an outlet of the first fan impeller assembly and an outlet disposed at least 1 meters from the inlet; a second fan impeller assembly located downstream from the outlet of the delivery pipe, wherein the second fan impeller assembly has a fan having blades that create air flow and further reduce the size of the ice particles received from the delivery pipe; and an outlet pipe that receives the ice particles discharged from the second fan impeller assembly and directs the ice particles into the air from an outlet of the outlet pipe into the air.

3. A remote, multi-functional snow-making apparatus, comprising: an ice particle generating machine comprising: a) a freezer unit that converts water to ice; and b) a comminuting device that reduces the ice produced by the freezer unit to ice particles smaller in size than the ice; an elongated delivery pipe having an inlet that receives ice particles from the ice particle generating machine; a fan impeller assembly located downstream from the delivery pipe and having a fan having blades that create airflow and further reduce the size of the ice particles; a chilled air sealed pneumatic air conveying system that includes an axial or centrifugal fan, and an air cooler, wherein the air conveying system has an outlet located between the ice particle generating machine and the fan impeller assembly, wherein the air conveying system further includes a sealed rotary valve which receives ice particles from the ice particle generating machine and blows the ice particles to the fan impeller assembly; and an outlet pipe that receives the ice particles discharged from the fan impeller assembly and directs the ice particles into the air from an outlet of the outlet pipe into the air.

4. The apparatus according to any of 1-3, wherein the elongated delivery pipe has a length between 1 meter and 100 meters.

5. The apparatus according to any of 1-4, wherein the apparatus further includes a deflector plate located downstream from the outlet of the outlet pipe and at least some of the ice particles exiting the outlet impact a surface of the deflector plate prior to mixing with the water droplets.

6. The apparatus according to 5, wherein the deflector plate is curved or straight and has a width from 2 to 8 times a width of the outlet pipe, and wherein when the deflector plate is curved, the curved deflector plate has an angle of about between 45 to 85°.

7. The apparatus according to any of 1-6, wherein the outlet pipe is operatively mounted in a stand, wherein the delivery pipe is upstream from and operatively connected to the outlet pipe.

8. The apparatus according to any of 1-7, wherein the water manifold is operatively connected to a rear side of the deflector plate, wherein the water manifold is connected to a heated water delivery pipe, wherein the water delivery pipe has a high-pressure hose coupling for providing pressurized water to the water manifold.

9. The apparatus according to 8, wherein the heated delivery pipe includes a drain for draining water from the heated delivery pipe and water manifold when not in use.

10. The apparatus according to any of 1 and 3-9, wherein the apparatus further includes a second fan impeller assembly located downstream from the delivery pipe, wherein the second fan impeller assembly has a fan having blades that create air flow and further reduce the size of the ice particles received from the delivery pipe.

11. The apparatus according to any of 1-10, wherein the elongated delivery pipe has a length between 2 meters and 50 meters, and wherein a second delivery pipe is connected to the outlet pipe, whereby the outlet of the outlet pipe is located at a height greater than 5 meters above the ground located below the second delivery pipe.

12. The apparatus according to 11, wherein the second delivery pipe is straight.

13. The apparatus according to any of 1 and 2 and 4-12, wherein the apparatus further includes a chilled air sealed pneumatic air conveying system includes an axial or centrifugal fan, and an air cooler, wherein the air conveying system is located between the ice particle generating machine and the fan impeller assembly, wherein the air conveying system further includes a sealed rotary valve which receives ice particles from the particle generating machine and blows the ice particles to the fan impeller assembly.

14. The apparatus according to any of 1-13, wherein the freezer unit comprises a drum evaporator freezer having an inner or outer wall cooled by a refrigerator condensing unit so that water flowing down the inner or outer wall is frozen and converted to ice, and wherein the comminuting device comprises a scraper blade assembly located in the drum evaporator freezer that scrapes ice off the inner or outer wall and converts the ice to ice particles.

15. The apparatus according to any of 1-14, wherein the apparatus includes a plurality of ice particle generating machines which are each operatively connected to an inlet of the elongated delivery pipe.

16. The apparatus according to any of 1-15, wherein the elongated delivery pipe has a diameter from about 2 inches to about 36 inches.

17. The apparatus according to any of 1 and 2 and 4-12, wherein the apparatus further includes one or more compressed air operated inline vacuum pump conveying systems, such as an ex air product, that are spaced at 20 to 35 meter intervals, wherein the conveying system is located between the ice particle generating machine and a fan impeller assembly of the carriage and blows the ice particles to the fan impeller assembly.

In accordance with the patent statutes, the best mode and preferred embodiment have been set forth; the scope of the invention is not limited thereto, but rather by the scope of the attached claims.

What is claimed is:

1. A remote, multi-functional snow-making apparatus, comprising:

an ice particle generating machine comprising:

a) a freezer unit that converts water to ice; and b) a comminuting device that reduces the ice produced by the freezer unit to ice particles smaller in size than the ice;

a fan impeller assembly that receives the ice particles from the ice particle generating machine and having a fan having blades that create airflow and further reduce the size of the ice particles;

an elongated delivery pipe having a length of at least 1 meter disposed between a discharge outlet of the apparatus and an outlet of the fan impeller assembly;

wherein the elongated delivery pipe includes a flexible tube;

wherein the discharge outlet receives the ice particles discharged from the fan impeller assembly through the elongated delivery pipe and directs the ice particles into the air; and a water manifold disposed adjacent to the discharge outlet, wherein a plurality of water nozzles are connected to the water manifold that expel pressurized water therethrough in the form of water droplets, and wherein the ice particles discharged from the discharge outlet mix with the water droplets expelled from the water nozzles thereby producing snow.

2. A remote, multi-functional snow-making apparatus, comprising:

an ice particle generating machine comprising:

a) a freezer unit that converts water to ice; and b) a comminuting device that reduces the ice produced by the freezer unit to ice particles smaller in size than the ice;

a first fan impeller assembly that receives the ice particles from the ice particle generating machine and having a fan having blades that create airflow and further reduce the size of the ice particles;

an elongated delivery pipe having an inlet connected to an outlet of the first fan impeller assembly and an outlet disposed at least 1 meter from the inlet;

wherein the elongated delivery pipe includes a flexible tube;

a second fan impeller assembly located downstream from the elongated delivery pipe, wherein the second fan impeller assembly has a fan having blades that create air flow and further reduce the size of the ice particles received from the elongated delivery pipe; and a discharge outlet that receives the ice particles discharged from the second fan impeller assembly and directs the ice particles into the air.

3. A remote, multi-functional snow-making apparatus, comprising:

an ice particle generating machine comprising:

a) a freezer unit that converts water to ice; and b) a comminuting device that reduces the ice produced by the freezer unit to ice particles smaller in size than the ice;

an elongated delivery pipe having an inlet that receives ice particles from the ice particle generating machine;

wherein the elongated delivery pipe includes a flexible tube;

a fan impeller assembly located downstream from the elongated delivery pipe and the ice particle generating machine and having a fan having blades that create airflow and further reduce the size of the ice particles;

a chilled air sealed pneumatic air conveying system that includes an axial or centrifugal fan, and an air cooler, wherein the air conveying system has an outlet located between the ice particle generating machine and the fan impeller assembly, wherein the air conveying system further includes a sealed rotary valve which receives ice particles from the ice particle generating machine and blows the ice particles through the elongated delivery pipe to the fan impeller assembly; and a discharge outlet that receives the ice particles discharged from the fan impeller assembly and directs the ice particles into the air.

4. The apparatus according to claim 1, wherein the elongated delivery pipe has a length between 1 meter and 100 meters, wherein the apparatus further includes a deflector plate located downstream from the discharge outlet and at least some of the ice particles exiting the discharge outlet impact a surface of the deflector plate prior to mixing with the water droplets, and wherein the elongated delivery pipe has a diameter from about 2 inches to about 36 inches.

5. The apparatus according to claim 4, wherein the deflector plate is curved or straight and has a width from 2 to 8 times a width of the outlet pipe, and wherein when the deflector plate is curved, the curved deflector plate has an angle of about between 45 to 85°, and wherein the discharge outlet is operatively mounted in a stand, wherein the elongated delivery pipe is upstream from and operatively connected to the discharge outlet pipe.

6. The apparatus according to claim 1, wherein the water manifold is operatively connected to a rear side of a deflector plate, wherein the water manifold is connected to a heated water delivery pipe, wherein the water delivery pipe has a high-pressure hose coupling for providing pressurized water to the water manifold, and wherein the heated water delivery pipe includes a drain for draining water from the heated water delivery pipe and water manifold when not in use.

7. The apparatus according to claim 1, wherein the apparatus further includes a second fan impeller assembly located downstream from the elongated delivery pipe, wherein the second fan impeller assembly has a fan having blades that create air flow and further reduce the size of the ice particles received from the elongated delivery pipe.

8. The apparatus according to claim 4, wherein the elongated delivery pipe has a length between 2 meters and 50 meters, and wherein a second delivery pipe is connected to the discharge outlet, whereby the discharge outlet is located at a height greater than 5 meters above the ground located below the second elongated delivery pipe, and wherein the second delivery pipe is straight.

9. The apparatus according to claim 1, wherein the apparatus further includes a chilled air sealed pneumatic air conveying system includes an axial or centrifugal fan, and an air cooler, wherein the air conveying system is located between the ice particle generating machine and the fan impeller assembly, wherein the air conveying system further includes a sealed rotary valve which receives ice particles from the particle generating machine and blows the ice particles to the fan impeller assembly.

10. The apparatus according to claim 1, wherein the freezer unit comprises a drum evaporator freezer having an inner or outer wall cooled by a refrigerator condensing unit so that water flowing down the inner or outer wall is frozen and converted to ice, and wherein the comminuting device comprises a scraper blade assembly located in the drum evaporator freezer that scrapes ice off the inner or outer wall and converts the ice to ice particles, and wherein the apparatus includes a plurality of ice particle generating machines which are each operatively connected to an inlet of the elongated delivery pipe.

11. The apparatus according to claim 1, wherein the apparatus further includes one or more compressed air operated inline vacuum pump conveying systems, wherein at least one of the conveying systems is located between the ice particle generating machine and a fan impeller assembly of the carriage and blows the ice particles to the fan impeller assembly.

12. The apparatus according to claim 2, wherein the elongated delivery pipe has a length between 1 meter and 100 meters, wherein the apparatus further includes a deflector plate located downstream from the discharge outlet and at least some of the ice particles exiting the discharge outlet impact a surface of the deflector plate prior to mixing with the water droplets, and wherein the elongated delivery pipe has a diameter from about 2 inches to about 36 inches.

13. The apparatus according to claim 12, wherein the deflector plate is curved or straight and has a width from 2 to 8 times a width of the outlet pipe, and wherein when the deflector plate is curved, the curved deflector plate has an angle of about between 45 to 85°, and wherein the discharge outlet is operatively mounted in a stand, wherein the elongated delivery pipe is upstream from and operatively connected to the discharge outlet.

14. The apparatus according to claim 2, wherein a water manifold is operatively connected to a rear side of a deflector plate and disposed adjacent to the discharge outlet, wherein the water manifold is connected to a heated water delivery pipe, wherein the water delivery pipe has a high-pressure hose coupling for providing pressurized water to the water manifold, and wherein the heated delivery pipe includes a drain for draining water from the heated delivery pipe and water manifold when not in use.

15. The apparatus according to claim 2, wherein the elongated delivery pipe has a length between 2 meters and 50 meters, and wherein a second delivery pipe is connected to the discharge outlet pipe, whereby the discharge outlet is located at a height greater than 5 meters above the ground located below the second delivery pipe, and wherein the second delivery pipe is straight, and wherein the apparatus further includes a chilled air sealed pneumatic air conveying system includes an axial or centrifugal fan, and an air cooler, wherein the air conveying system is located between the ice particle generating machine and the fan impeller assembly, and wherein the air conveying system further includes a sealed rotary valve which receives ice particles from the particle generating machine and blows the ice particles to the fan impeller assembly.

16. The apparatus according to claim 2, wherein the freezer unit comprises a drum evaporator freezer having an inner or outer wall cooled by a refrigerator condensing unit so that water flowing down the inner or outer wall is frozen and converted to ice, and wherein the comminuting device comprises a scraper blade assembly located in the drum evaporator freezer that scrapes ice off the inner or outer wall and converts the ice to ice particles, and wherein the apparatus includes a plurality of ice particle generating machines which are each operatively connected to an inlet of the elongated delivery pipe, and wherein the apparatus further includes one or more compressed air operated inline vacuum pump conveying systems, and wherein at least one of the conveying systems is located between the ice particle generating machine and a fan impeller assembly of the carriage and blows the ice particles to the fan impeller assembly.

17. The apparatus according to claim 3, wherein the elongated delivery pipe has a length between 1 meter and 100 meters, wherein the apparatus further includes a deflector plate located downstream from the discharge outlet and at least some of the ice particles exiting the discharge outlet impact a surface of the deflector plate prior to mixing with the water droplets, and wherein the elongated delivery pipe has a diameter from about 2 inches to about 36 inches.

18. The apparatus according to claim 17, wherein the deflector plate is curved or straight and has a width from 2 to 8 times a width of the outlet pipe, and wherein when the deflector plate is curved, the curved deflector plate has an angle of about between 45 to 85°, and wherein the discharge outlet is operatively mounted in a stand, wherein the elongated delivery pipe is upstream from and operatively connected to the discharge outlet, and wherein a water manifold is operatively connected to a rear side of the deflector plate, wherein the water manifold is connected to a heated water delivery pipe, wherein the water delivery pipe has a high-pressure hose coupling for providing pressurized water to the water manifold, and wherein the heated water delivery pipe includes a drain for draining water from the heated water delivery pipe and water manifold when not in use.

19. The apparatus according to claim 3, wherein the apparatus further includes a second fan impeller assembly located downstream from the elongated delivery pipe, wherein the second fan impeller assembly has a fan having blades that create air flow and further reduce the size of the ice particles received from the elongated delivery pipe, and wherein the elongated delivery pipe has a length between 2 meters and 50 meters, and wherein a second delivery pipe is connected to the discharge outlet pipe, whereby the discharge outlet of the outlet pipe is located at a height greater than 5 meters above the ground located below the second delivery pipe, and wherein the second delivery pipe is straight.

20. The apparatus according to claim 3, wherein the freezer unit comprises a drum evaporator freezer having an inner or outer wall cooled by a refrigerator condensing unit so that water flowing down the inner or outer wall is frozen and converted to ice, and wherein the comminuting device comprises a scraper blade assembly located in the drum evaporator freezer that scrapes ice off the inner or outer wall and converts the ice to ice particles, and wherein the apparatus includes a plurality of ice particle generating machines which are each operatively connected to an inlet of the elongated delivery pipe, and wherein the apparatus further includes one or more compressed air operated inline vacuum pump conveying systems, and wherein at least one of the conveying systems is located between the ice particle generating machine and a fan impeller assembly of the carriage and blows the ice particles to the fan impeller assembly.

* * * * *